US005452043A

United States Patent [19]

Patton et al.

[11] Patent Number: 5,452,043

[45] Date of Patent: Sep. 19, 1995

[54] RACK AND A TANK FOR A PHOTOGRAPHIC LOW VOLUME THIN TANK INSERT FOR A RACK AND A TANK PHOTOGRAPHIC PROCESSING APPARATUS

[75] Inventors: David L. Patton, Webster; John H. Rosenburgh, Hilton, both of N.Y.

[73] Assignee: Eastman Kodak Company, Rochester, N.Y.

[21] Appl. No.: 20,311

[22] Filed: Feb. 19, 1993

[51] Int. Cl.[6] ..... G03D 3/02; G03D 13/02

[52] U.S. Cl. ..... 354/324; 354/331; 354/325

[58] Field of Search ..... 354/318–324, 354/325, 331, 336, 339; 134/64 P, 122 P

[56] References Cited

U.S. PATENT DOCUMENTS

| | | | |
|---|---|---|---|
| 717,021 | 12/1902 | Pollak . | |
| 1,223,664 | 4/1917 | Brewster | 354/317 |
| 1,867,172 | 7/1932 | Ranger . | |
| 2,248,056 | 7/1941 | Blaney | 354/321 |
| 2,614,472 | 10/1952 | Luboshez | 354/325 X |
| 2,892,394 | 6/1959 | Hixon et al. | 354/328 |
| 3,025,779 | 3/1962 | Russell et al. | 34/160 X |
| 3,180,243 | 4/1965 | Siskind et al. | 134/94 |
| 3,362,315 | 1/1968 | Buechner | 220/408 X |
| 3,372,630 | 5/1968 | Schmidt | 354/319 |
| 3,528,760 | 9/1970 | Buechner | 354/324 |
| 3,538,835 | 11/1970 | Needleman | 354/324 |
| 3,598,037 | 8/1971 | Houston | 354/319 |
| 3,601,029 | 8/1971 | Needleman | 354/324 |
| 3,604,331 | 9/1971 | Carberry et al. | 354/324 |
| 3,774,521 | 11/1973 | Beck | 354/324 X |
| 3,860,944 | 1/1975 | Huber et al. | 354/324 |
| 3,877,805 | 4/1975 | Heldenbrand et al. | 355/10 |
| 3,886,575 | 5/1975 | Gall | 354/311 |

(List continued on next page.)

FOREIGN PATENT DOCUMENTS

| | | | |
|---|---|---|---|
| 0222583A3 | 11/1986 | European Pat. Off. . | |
| 0559028A1 | 2/1993 | European Pat. Off. . | |
| 549974 | 2/1923 | France . | |
| 2622708 | 2/1987 | France . | |
| 1029674 | 5/1958 | Germany . | |
| 1034979 | 7/1958 | Germany | 354/331 |
| 2047864 | 4/1972 | Germany . | |
| 3242810 | 5/1984 | Germany | 354/324 |
| 243782 | 11/1987 | Germany . | |
| 4428034 | 11/1969 | Japan . | |
| 1022123 | 11/1979 | Japan . | |
| 59-38743 | 3/1984 | Japan . | |
| 027040 | 1/1990 | Japan . | |
| 2048661 | 2/1990 | Japan . | |
| 2-79844 | 3/1990 | Japan . | |
| 2067552 | 3/1990 | Japan . | |
| 2067553 | 3/1990 | Japan . | |
| 2-129637 | 5/1990 | Japan . | |
| 3-59655 | 3/1991 | Japan . | |
| 764412 | 12/1956 | United Kingdom . | |
| 889384 | 2/1962 | United Kingdom . | |
| 965387 | 7/1964 | United Kingdom . | |
| 1028216 | 5/1966 | United Kingdom . | |
| 1411343 | 10/1975 | United Kingdom . | |
| 2191082 | 12/1987 | United Kingdom . | |
| 9012860 | 6/1990 | United Kingdom . | |
| 9114090 | 6/1991 | United Kingdom . | |
| 451981 | 3/1973 | U.S.S.R. . | |
| WO93/00612 | 1/1993 | WIPO . | |

OTHER PUBLICATIONS

Jun. 1979 IBM Technical Disclosure—Anderson et al.

*Primary Examiner*—D. Rutledge

*Attorney, Agent, or Firm*—Frank Pincelli

[57] ABSTRACT

An apparatus for making a low volume photographic material processing apparatus employing a rack and a tank out of an existing larger volume photographic processing apparatus. The converted photographic processing apparatus will contain a smaller volume of the same photographic solution that was previously used in non-converted processing tanks.

2 Claims, 7 Drawing Sheets

U.S. PATENT DOCUMENTS

| | | | |
|---|---|---|---|
| 3,916,426 | 10/1975 | Bown | 354/319 |
| 3,981,583 | 9/1976 | Tsuchida et al. | 355/100 |
| 4,100,560 | 7/1978 | Schochet | 354/307 |
| 4,123,769 | 10/1978 | Fernandez | 354/322 |
| 4,213,420 | 7/1980 | Martino | 118/713 |
| 4,222,657 | 9/1980 | Leuchter | 354/324 |
| 4,248,513 | 2/1981 | Caccamisi | 354/299 |
| 4,295,730 | 10/1981 | Fraser | 354/325 |
| 4,327,987 | 5/1982 | Friar et al. | 354/317 |
| 4,332,455 | 6/1982 | Stettner | 354/324 |
| 4,359,279 | 11/1982 | Popoff | 354/320 |
| 4,362,377 | 12/1982 | Yoshida et al. | 354/320 |
| 4,371,250 | 2/1983 | Wakabayashi et al. | 354/325 |
| 4,398,818 | 8/1983 | Jeromin et al. | 355/10 |
| 4,428,659 | 1/1984 | Howard | 354/317 |
| 4,429,981 | 1/1984 | Frazier | 354/316 |
| 4,439,033 | 3/1984 | Freeman | 354/316 |
| 4,464,035 | 8/1984 | Schoering | 354/299 |
| 4,480,907 | 11/1984 | Vackier | 355/10 |
| 4,512,645 | 4/1985 | Engelhardt et al. | 354/324 |
| 4,534,635 | 8/1985 | Johnston et al. | 354/322 |
| 4,613,223 | 9/1986 | Cherry et al. | 354/322 |
| 4,687,313 | 8/1987 | Tankguchi | 354/320 |
| 4,688,917 | 8/1987 | Muller et al. | 354/320 |
| 4,708,452 | 11/1987 | Schoen | 354/317 |
| 4,708,453 | 11/1987 | Fryda et al. | 354/320 |
| 4,745,423 | 5/1988 | Uchida | 354/320 |
| 4,758,858 | 7/1988 | Blackman et al. | 354/321 |
| 4,827,309 | 5/1989 | Kato | 355/256 |
| 4,837,593 | 6/1989 | Hehn | 354/325 X |
| 4,853,727 | 8/1989 | Ganzke | 354/319 |
| 4,888,608 | 12/1989 | Kümmerl | 354/322 |
| 4,902,608 | 2/1990 | Lamb et al. | 430/325 |
| 4,922,276 | 5/1990 | Lamprecht et al. | 354/299 |
| 4,926,211 | 5/1990 | Ozawa | 355/28 |
| 4,929,974 | 5/1990 | Sakamoto et al. | 354/299 |
| 4,969,002 | 11/1990 | Nakayama | 354/325 |
| 4,972,219 | 11/1990 | Yamada | 354/322 |
| 4,987,438 | 1/1991 | Goto et al. | 354/319 |
| 4,989,028 | 1/1991 | Hall et al. | 354/324 |
| 4,994,840 | 2/1991 | Hall et al. | 354/324 |
| 5,023,644 | 6/1991 | Kurematsu et al. | 354/320 |
| 5,034,767 | 7/1991 | Netz et al. | 354/317 |
| 5,043,756 | 8/1991 | Takabayashi et al. | 354/320 |
| 5,055,870 | 10/1991 | Ohba et al. | 354/317 |
| 5,075,711 | 12/1991 | Ohba | 354/320 |
| 5,108,878 | 4/1992 | Nakamura | 354/324 X |
| 5,243,373 | 9/1993 | Glover et al. | 354/331 X |
| 5,270,762 | 12/1993 | Rosenburgh et al. | 354/324 |
| 5,294,956 | 3/1994 | Earle | 354/331 X |

RACK AND A TANK FOR A PHOTOGRAPHIC LOW VOLUME THIN TANK INSERT FOR A RACK AND A TANK PHOTOGRAPHIC PROCESSING APPARATUS

CROSS REFERENCE TO RELATED APPLICATIONS

Reference is made to commonly assigned copending patent applications: Ser. No. 844,820, now U.S. Pat. No. 5,311,235 entitled "A DRIVING MECHANISM FOR A PHOTOGRAPHIC PROCESSING APPARATUS" filed Mar. 2, 1992 in the names of Ralph L. Piccinino, Jr., David L. Patton, Roger E. Bartell, Anthony Earle, and John Rosenburgh, Ser. No. 844,343, now U.S. Pat. No. 5,179,404 entitled "ANTI-WEB ADHERING CONTOUR SURFACE FOR A PHOTOGRAPHIC PROCESSING APPARATUS" filed Mar. 2, 1992 in the names of Roger E. Bartell, Ralph L. Piccinino, Jr., John H. Rosenburgh, Anthony Earle, and David L. Patton, Ser. No. 844,355, now U.S. Pat. No. 5,270,762 entitled "A SLOT IMPINGEMENT FOR A PHOTOGRAPHIC PROCESSING APPARATUS" filed Mar. 2, 1992 in the names of John Rosenburgh, David L. Patton, Ralph L. Piccinino, Jr., and Anthony Earle, Ser. No. 844,815 entitled "A RACK AND A TANK FOR A PHOTOGRAPHIC PROCESSING APPARATUS" filed Mar. 2, 1992 in the names of David L. Patton, Roger E. Bartell, John H. Rosenburgh and Ralph L. Piccinino, Jr. and Ser. No. 855,806, now U.S. Pat. No. 5,309,191 entitled "RECIRCULATION, REPLENISHMENT, REFRESH, RECHARGE AND BACKFLUSH FOR A PHOTOGRAPHIC PROCESSING APPARATUS" filed Mar. 2, 1992 in the names of Roger E. Bartell, David L. Patton, John Rosenburgh, and Ralph L. Piccinino, Jr.

FIELD OF THE INVENTION

The invention relates to the field of photography, and particularly to a photosensitive material processing apparatus.

BACKGROUND OF THE INVENTION

The processing of photographic film involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, employing a rack and a tank, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

The chemicals contained in the photographic solution: cost money to purchase; change in activity and leach out or season during the photographic process; and after the chemicals are used the chemicals must be disposed of in an environmentally safe manner. Thus, it is important in all sizes of photofinishing apparatus to reduce the volume of processing solution. The prior art suggest various types of replenishing systems that add or subtract specific chemicals to the photographic solution to maintain a consistency of photographic characteristics in the material developed. It is possible to maintain reasonable consistency of photographic characteristics only for a certain period of replenishment. After a photographic solution has been used a given number of times, the solution is discarded and a new photographic solution is added to the tank.

PROBLEMS TO BE SOLVED BY THE INVENTION

Activity degradation due to instability of the chemistry, or chemical contamination, after the components of the photographic solution are mixed together causes one to discard the photographic solution. Some of the steps in the photographic process utilize photographic solutions that contain chemicals that are unstable, i.e., they have a short process life. Thus, photographic solutions in tanks that contain unstable chemicals are discarded more frequently than photographic solutions in tanks that contain stable chemicals.

A problem with existing processing tanks is that large amounts of photosensitive material must be run through the processing solution in order to create and maintain a seasoned and stable photographic process. A seasoned and stable photographic process is maintained by the processing of the photosensitive material and the addition of new processing chemicals which replace and flush out the spent or exhausted chemicals. If the above was not done in a timely manner, the processing chemicals will lose their potency and not operate properly, thereby necessitating their replacement. The above problem is exacerbated in an existing larger tank processing apparatus, or minilab that is under utilized.

The prior art suggest that if the volume of the various tanks contained within various sizes of photographic processing apparatus were reduced the same amount of film or photographic paper may be processed, while reducing the volume of photographic solution that was used and subsequently discarded. One of the problems in using larger volume tanks is that the larger volume tanks contain larger volumes of photographic solutions. When the photographic solutions because unusable because of chemical breakdown, or exhausted they must be disposed of in an environmentally safe manner. Thus, the larger the tank the more processing solution that must be disposed.

Occasionally processing solutions become contaminated at which point the processing solution must also be disposed of in an environmentally safe manner. Thus, larger tanks require more processing solution which must be disposed of and replaced. Any opportunity to reduce the volume of an existing photographic processor tank without reducing agitation and photographic process activity whether it be a large processing apparatus containing 100 liters per tank or a microlab containing 10 liters per tank, will be warranted.

ADVANTAGEOUS EFFECTS OF THE INVENTION

This invention overcomes the disadvantages of the prior art by creating a low volume photographic material processing apparatus employing a rack and a tank out of an existing larger volume photographic processing apparatus. The converted photographic processing apparatus will contain a smaller volume of the same photographic solution that was previously used in non-converted processing tanks. In fact, in some instances, the volume of photographic solution utilized in converted tanks may be greatly reduced. Hence, the apparatus of this invention is capable of reducing the volume of photographic solution that is used and subsequently discarded by non converted photographic processing apparatus, while providing more efficient and increased agitation than previously existed in larger volume tanks.

Another advantage is that the photographic solution contained in the apparatus of this invention, when exposed to the photosensitive material, will reach a seasoned state more rapidly than prior art larger volume tanks. The reason for the above is that the volume of the photographic processing solution is less.

SUMMARY OF THE INVENTION

The foregoing is accomplished by providing a rack and tank apparatus for processing photosensitive materials, in which processing solution flows through a rack and a tank, the rack and the tank are relatively dimensioned so that a volume for holding and moving processing solution and photosensitive material is formed, the apparatus characterized by: the rack containing first fluid displacement means to displace sufficient processing solution so that a smaller volume for holding and moving processing solution and photosensitive material is formed between the rack and the tank.

DESCRIPTION OF THE PREFERRED EMBODIMENT

Figure 1:
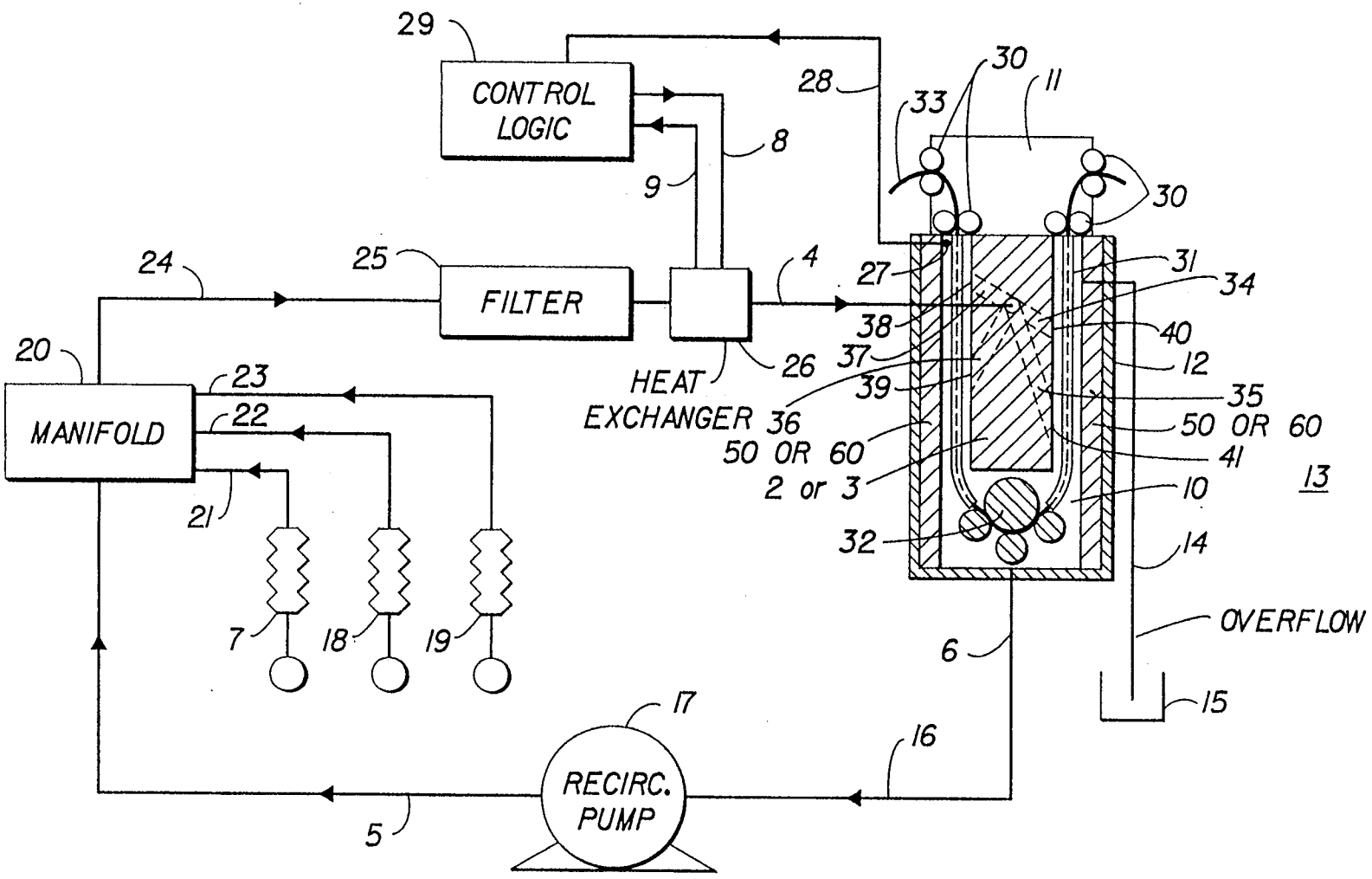
FIG. 1 is a schematic drawing of the apparatus of this invention.

Referring now to the drawings in detail, and more particularly to FIG. 1, the reference character 11 represents an existing rack of a larger tank 12. Rack 11 and tank 12 form an existing larger volume photosensitive material processing vessel 13.

A typical rack 11 that is used in a minilab photographic processing apparatus comprises: entry and exit roller sets 30; photosensitive material guides 31; and turn around roller assembly 32. Photosensitive material 33 will travel through tank 12 by means of rollers 30 and 32 and guides 31.

When inserts 2 or 3 and inserts 50 or 60 are placed in rack 11 and tank 12, a space 10 is formed. Inserts 2, 3, 50 and 60 are designed in a manner to minimize the volume of space 10 (the space through which photosensitive material 33 travels). The outlet 6 of vessel 13 is connected to recirculating pump 17 via conduit 16. Recirculating pump 17 is connected to manifold 20 via conduit 5 and manifold 20 is coupled to filter 25 via conduit 24. Filter 25 is connected to heat exchanger 26 and heat exchanger 26 is connected to control logic 29 via wire 9. Control logic 29 is connected to heat exchanger 26 via wire 8 and sensor 27 is connected to control logic 29 via wire 28. Metering pumps 7, 18 and 19 are respectively connected to manifold 20 via conduits 21, 22 and 23.

The photographic processing chemicals that comprise the photographic solution are placed in metering pumps 7, 18 and 19. Pumps 7, 18 and 19 are used to place the correct amount of chemicals in manifold 20. Manifold 20 introduces the photographic processing solution into conduit 24.

The photographic processing solution flows into filter 25 via conduit 24. Filter 25 removes particulate matter and dirt that may be contained in the photographic processing solution. After the photographic processing solution has been filtered, the solution enters heat exchanger 26.

Sensor 27 senses the temperature of the solution and transmits the temperature of the solution to control logic 29 via wire 28. For example, control logic 29 is the series CN 310 solid state temperature controller manufactured by Omega Engineering, Inc. of 1 Omega Drive, Stamford, Conn. 06907. Logic 29 compares the solution temperature sensed by sensor 27 and the temperature that exchanger 26 transmitted to logic 29 via wire 9. Logic 29 will inform exchanger 26 via wire 8 to add or remove heat from the solution. Thus, logic 29 and heat exchanger 26 modify the temperature of the solution and maintain the solution temperature at the desired level.

At this point the solution passes through insert 2 or insert 3 via inlet 4 and then is dispersed via conduits 34, 35, 36 or 37 to nozzles 38, 39, 40 and 41. Processing solution exits slot nozzles 38, 39, 40 and 41 entering space 10 of vessel 13 impinging on photosensitive material 33. When space 10 contains too much processing solution, the excess solution will be removed by drain 14 and flow into reservoir 15. The remaining solution will circulate through space 10 and reach outlet line 6. Thereupon, the solution will pass from outlet line 6 to conduit line 16 to recirculation pump 17. The photographic solution contained in the apparatus of this invention, when exposed to photosensitive material 33, will reach a seasoned state more rapidly than larger volume prior art systems, because the volume of the photographic processing solution is less.

Figure 2:
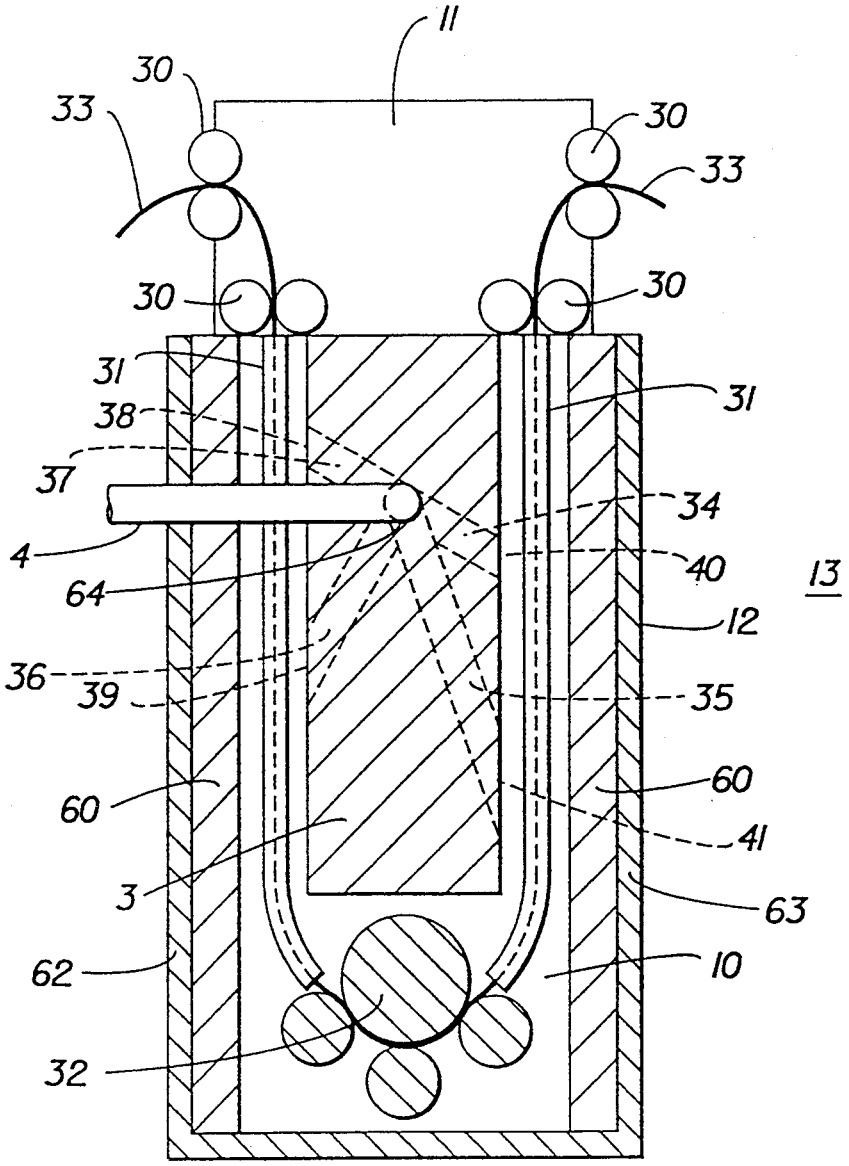
FIG. 2 is a perspective drawing showing rack 11, tank 12 and inserts 3 and 60 being used to convert an existing minilab photographic processing apparatus or micro photographic processing apparatus into a lower volume tank.

FIG. 2 is a perspective drawing showing rack 11, tank 12 forming vessel 13 and inserts 3 and 60 being used to convert an existing minilab photographic processing apparatus or microlab photographic processing apparatus into a lower volume tank. In this embodiment slot nozzles 38–41 are located in insert 3. Rack 11 comprises entry and exit roller sets 30; photosensitive material guides 31; and turn around roller assembly 32. Photosensitive material 33 will travel through space 10 by means of rollers 30 and 32 and guides 31.

When inserts 3 and 60 are placed in rack 11 and tank 12, a low volume space 10 is formed. Insert 3 is attached to rack 11 via guides 31 or insert 3 is attached to a portion of the frame structure of rack 11, by any known means, i.e. screws, rivets, etc. Insert 60 is attached to tank 12, walls 62 and 63 by any known means i.e. screws rivets, etc.

Photographic processing solution will pass through insert 3 via inlet 4 and then the solution proceeds through connecter 64, conduits 34, 35, 36 and 37 to nozzles 38, 39, 40 and 41. At this point processing solution will exit slot nozzles 38, 39, 40 and 41 and enter space 10 of vessel 13 impinging on photosensitive material 33. The amount of fresh processing solution exiting slot nozzles 38, 39, 40 and 41 is at a sufficient velocity to disrupt the boundary layer of exhausted processing solution allowing fresh processing solution to reach the surfaces of photosensitive material 33. Slot nozzles 38–41 permit the velocity of the exiting processing solution to be varied by changing the pressure of the solution. Thus, controlling the amount of fresh processing solution reaching the surfaces of photosensitive material 33. Hence, the chemical reaction between photosensitive material 33 and the fresh processing solution reaching the surface of photosensitive material 33 may be controlled.

Additional slot nozzles may be utilized to control the amount of chemical reaction between the fresh processing solution and photosensitive material 33. Thus, the volume of tank 12 containing processing solution i.e. space 10, was substantially reduced, while providing increased solution agitation and increased photographic processing solution activity.

Figure 3:
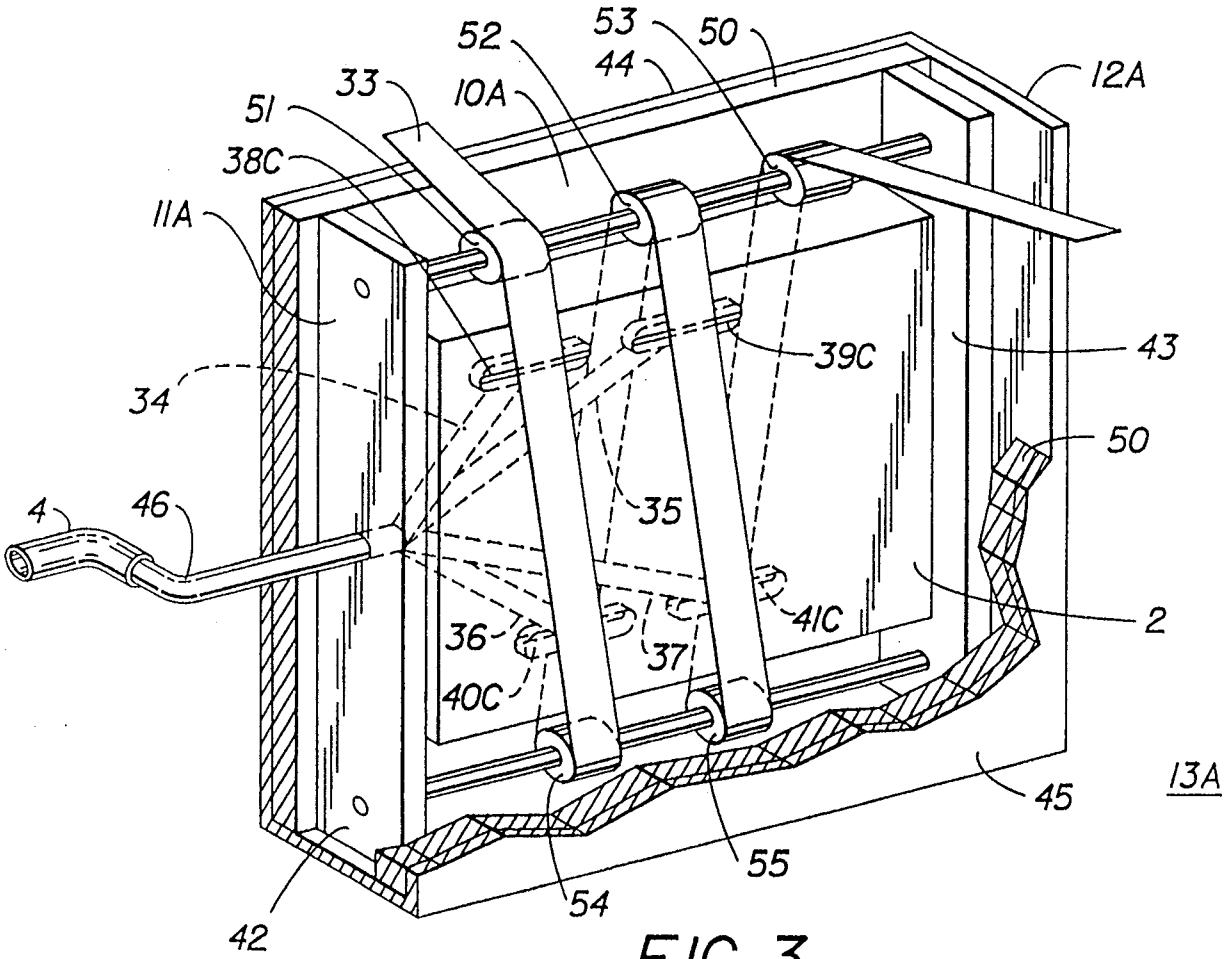
FIG. 3 is a perspective drawing showing rack 11A, tank 12A and inserts 2 and 50A being used to convert an existing larger volume processing vessel 13 into a lower volume tank.

FIG. 3 is a perspective drawing showing rack 11A, tank 12A and insert 2 being used to convert a existing larger volume processing vessel 13A into a lower volume tank. In this embodiment nozzles 38C–41C are located in insert 2. Rack 11A comprises rollers 51, 52, 53, 54 and 55 and side supports 42 and 43. Rollers 51, 52, 53, 54 and 55 are used to transport photosensitive material 33 through space 10A. Rack 11A and tank 12A are examples of a typical rack and a typical tank that are currently being used in large photographic processing apparatus. Rack 11A and tank 12A may be respectively substituted for rack 11 and tank 12 of FIG. 1.

When inserts 2 and 50 are placed in rack 11A and tank 12A, a low volume space 10A is formed. Insert 2 is attached to rack 11A side supports 42 and 43 by any known means, i.e., screws, rivets, etc., and insert 50 is attached to walls 44 and 45 of tank 12A, by any known means i.e. screws, rivets, etc.

Photographic processing solution will pass through insert 2 via inlet 4 and then the solution will proceed through connector 46, conduits 34, 35, 36 and 37 to nozzles 38C, 39C, 40C and 41C. At this point the processing solution will exit slot nozzles 38C, 39C, 40C and 41C and enter space 10A of vessel 13A impinging on photosensitive material 33.

Slot nozzles 38C, 39C, 40C and 41C fluid distribution pattern meets or exceeds the width of photosensitive material 33. The amount of fresh processing solution exiting slot nozzles 38C, 39C, 40C and 41C is at a sufficient velocity to disrupt the boundary layer of exhausted processing solution allowing fresh processing solution to reach the surfaces of photosensitive material 33. Slot nozzles 38C–41C permit the velocity of the exiting processing solution to be varied by changing the pressure of the solution. Thus, controlling the amount of fresh processing solution reaching the surfaces of photosensitive material 33. Hence, the chemical reaction between photosensitive material 33 and the fresh processing solution reaching the surface of photosensitive material 33 may be controlled.

Additional slot nozzles may be utilized to control the amount of chemical reaction between the fresh processing solution and photosensitive material 33. Thus, the processing solution volume of tank 12A in space 10A was substantially reduced while providing increased solution agitation and increased solution activity.

Figure 4:
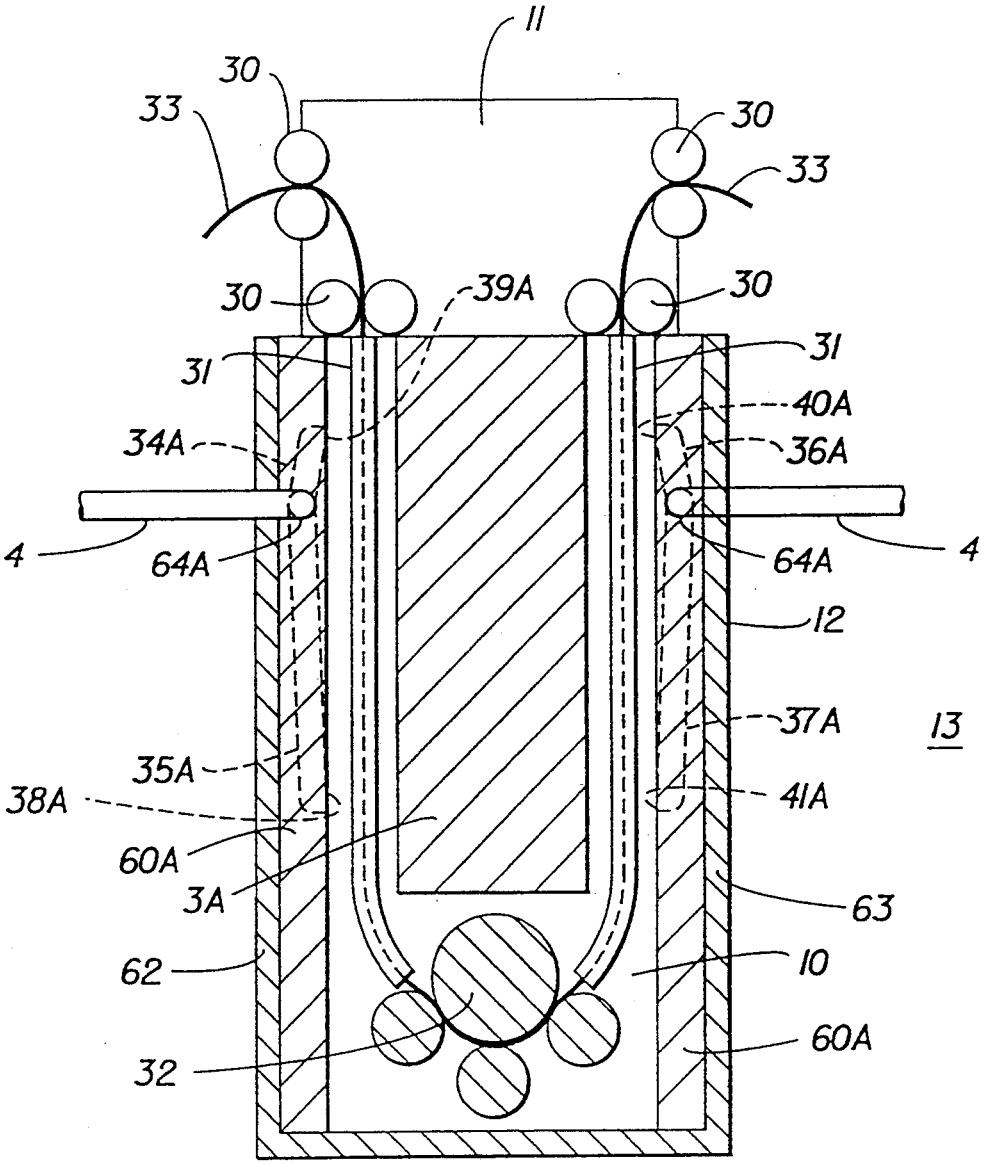
FIG. 4 is a perspective drawing showing rack 11, tank 12 and inserts 3A and 60A being used to convert an existing minilab photographic processing apparatus or micro photographic processing apparatus into a lower volume tank.

FIG. 4 is a perspective drawing showing rack 11, tank 12 and inserts 3A and 60A being used to convert an existing mini photographic processing apparatus or micro photographic processing apparatus into a lower volume tank. In this embodiment nozzles 38A–41A are located in insert 60A. Rack 11 comprises entry and exit roller sets 30; photosensitive material guides 31; and turn around roller assembly 32. Photosensitive material 33 will travel through space 10 by means of rollers 30 and 32 and guides 31.

When inserts 3A and 60A are placed in rack 11 and tank 12, a low volume space 10 is formed. Insert 3A is attached to rack 11 via guides 31 or a portion of rack 11 frame structure 61, by any known means, i.e. screws, rivets, etc. and insert 60A is attached to tank 12, walls 62 and 63 by any known means i.e. screws rivets, etc.

Photographic processing solution will pass through insert 60A via inlet 4 and then the solution proceeds through connecter 64, conduits 34A, 35A, 36A and 37A to nozzles 38A, 39A, 40A and 41A. At this point processing solution will exit slot nozzles 38A, 39A, 40A and 41A and enter space 10 of vessel 13 impinging on photosensitive material 33. The amount of fresh processing solution exiting slot nozzles 38A, 39A, 40A and 41A is at a sufficient velocity to disrupt the boundary layer of exhausted processing solution allowing fresh processing solution to reach the surfaces of photosensitive material 33. Slot nozzles 38A–41A permit the velocity of the exiting processing solution to be varied by changing the pressure of the solution. Thus, controlling the amount of fresh processing solution reaching the surfaces of photosensitive material 33. Hence, the chemical reaction between photosensitive material 33 and the fresh processing solution reaching the surface of photosensitive material 33 may be controlled.

Additional slot nozzles may be utilized to control the amount of chemical reaction between the fresh processing solution and photosensitive material 33. Thus, the volume of tank 12 containing processing solution i.e. space 10 was substantially reduced while providing increased solution agitation and increased photographic processing solution activity.

Figure 5:
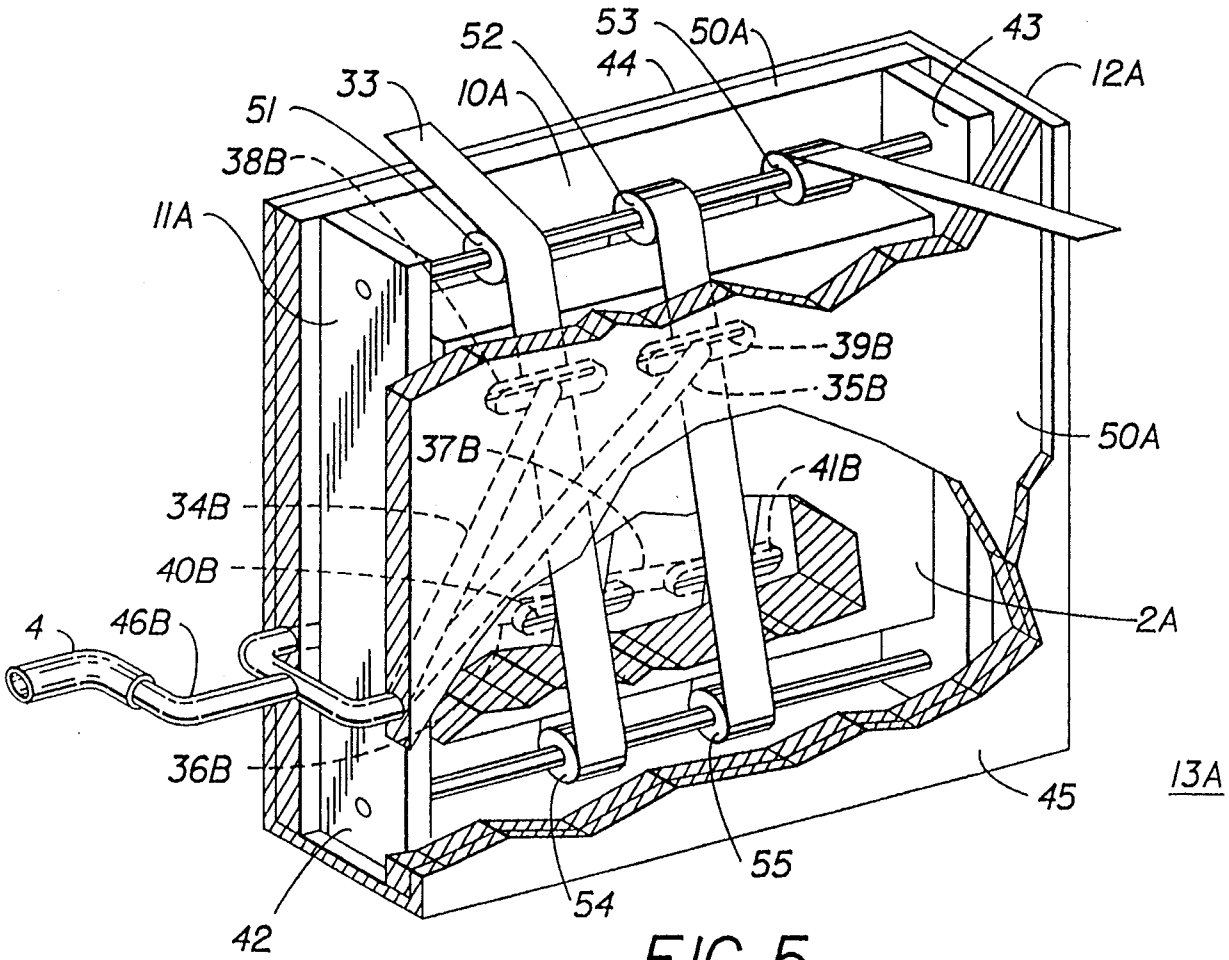
FIG. 5 is a perspective drawing showing rack 11A, tank 12A and insert 2A being used to convert a larger volume processing vessel 13 into a lower volume tank.

FIG. 5 is a perspective drawing showing rack 11A, tank 12A and insert 2A being used to convert a larger volume processing vessel 13A into a lower volume tank. In this embodiment nozzles 38B–41B are shown in insert 50A. Rack 11A comprises rollers 51, 52, 53, 54 and 55 and side supports 42 and 43. Rollers 51, 52, 53, 54 and 55 are used to transport photosensitive material 33 through space 10A. Rack 11A and tank 12A are examples of a typical rack and a typical tank that are currently being used in large photographic processing apparatus. Rack 11A and tank 12A may be respectively substituted for rack 11 and tank 12 of FIG. 1.

When inserts 2A and 50A are placed in rack 11A and tank 12A, a low volume space 10A is formed. Insert 2A is attached to rack 11A side supports 42 and 43 by any known means, i.e., screws, rivets, etc., and insert 50A is attached to tank 12A, walls 44 and 45 by any known means i.e. screws, rivets, etc.

Photographic processing solution will pass through insert 50A via inlet 4 and then the solution will proceed through connector 46B, conduits 34B, 35B, 36B and 37B to nozzles 38B, 39B, 40B and 41B. At this point the processing solution will exit slot nozzles 38B, 39B, 40B and 41B and enter space 10A of vessel 13A impinging on photosensitive material 33.

Slot nozzles 38B, 39B, 40B and 41B fluid distribution pattern meets or exceeds the width of photosensitive material 33. The amount of fresh processing solution exiting slot nozzles 38B, 39B, 40B and 41B is at a sufficient velocity to disrupt the boundary layer of exhausted processing solution allowing fresh processing solution to reach the surfaces of photosensitive material 33. Slot nozzles 38B–41B permit the velocity of the exiting processing solution to be varied by changing the pressure of the solution. Thus, controlling the amount of fresh processing solution reaching the surfaces of photosensitive material 33. Hence, the chemical activity between photosensitive material 33 and the fresh processing solution reaching the surface of photosensitive material 33 may be controlled.

Additional slot nozzles may be utilized to control the amount of chemical reaction between the fresh processing solution and photosensitive material 33. Thus, the processing solution volume of tank 12A in space 10A was substantially reduced while providing increased solution agitation and increased solution activity.

Figure 6:
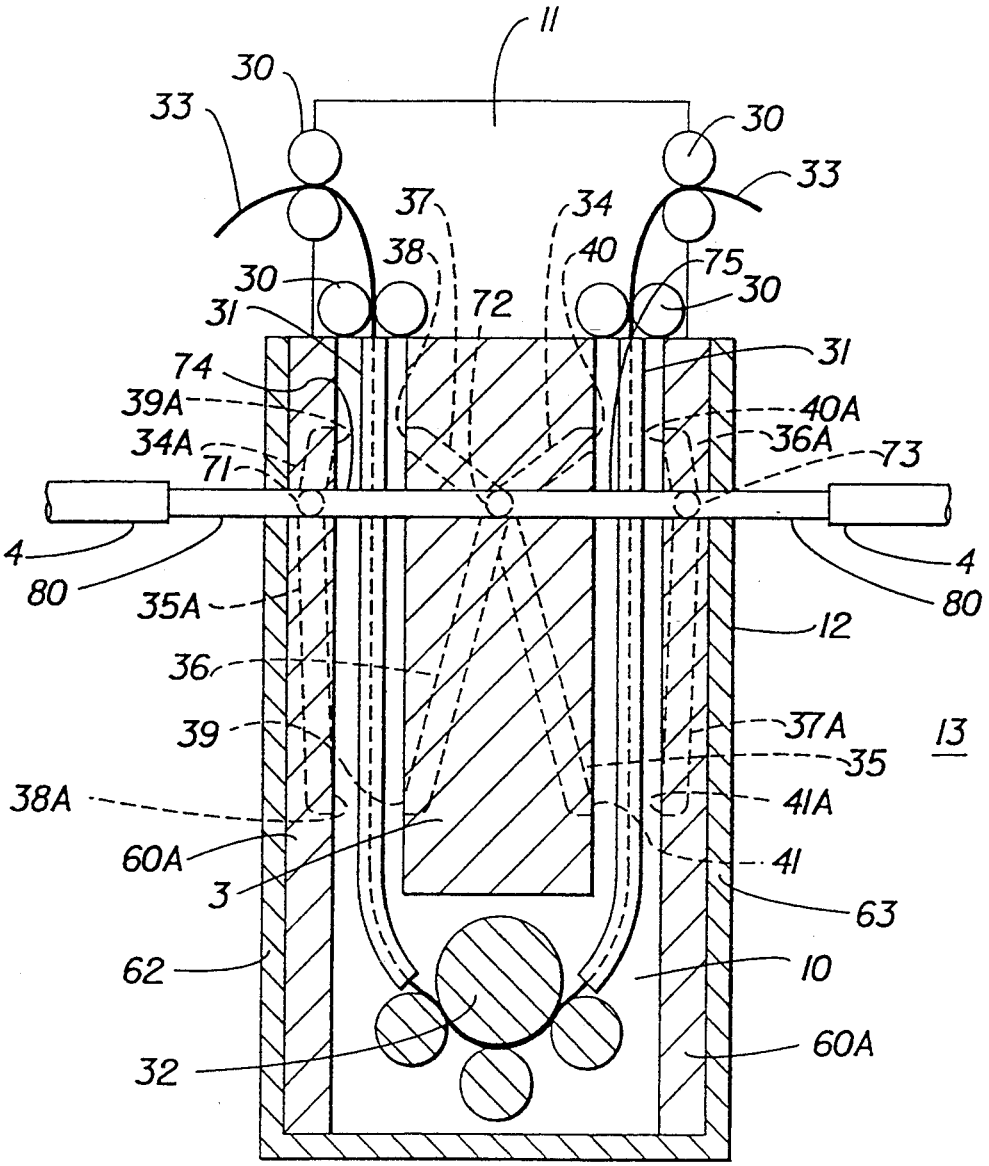
FIG. 6 is a perspective drawing showing rack 11, tank 12 and inserts 3 and 60A being used to convert an existing minilab photographic processing apparatus or micro photographic processing apparatus into a lower volume tank.

FIG. 6 is a perspective drawing showing rack 11, tank 12 and inserts 3 and 60A being used to convert an existing minilab photographic processing apparatus or microlab photographic processing apparatus into a lower volume tank. In this embodiment slot nozzles 38–41 are located in insert 3 and slot nozzles 38A–41A are located in insert 60A. Rack 11 comprises entry and exit roller sets 30; photosensitive material guides 31; and turn around roller assembly 32. Photosensitive material 33 will travel through space 10 by means of rollers 30 and 32 and guides 31.

When inserts 3 and 60A are placed in rack 11 and tank 12, a low volume space 10 is formed. Insert 3 is attached to rack 11 via guides 31 or insert 3 is attached to a portion of the frame structure of rack 11, by any known means, i.e. screws, rivets, etc. Insert 60A is attached to tank 12, walls 62 and 63 by any known means i.e. screws rivets, etc.

Photographic processing solution will pass through insert 3 via inlet 4 and conduit 80 and then the solution proceeds through connecters 71, 72 and 73 and conduits 74 and 75 to conduits 34, 35, 36 and 37 to nozzles 38, 39, 40 and 41 and conduits 34A, 35A, 36A and 37A to nozzles 38A, 39A, 40A and 41A. At this point processing solution will exit slot nozzles 38, 39, 40, 41, 38A, 39A, 40A and 41A and enter space 10 of vessel 13 impinging on photosensitive material 33. The amount of fresh processing solution exiting slot nozzles 38, 39, 40, 41, 38A, 39A, 40A and 41A is at a sufficient velocity to disrupt the boundary layer of exhausted processing solution allowing fresh processing solution to reach the surfaces of photosensitive material 33. Slot nozzles 38–41 and slot nozzles 38A– 41A permit the velocity of the exiting processing solution to be varied by changing the pressure of the solution. Thus, controlling the amount of fresh processing solution reaching the surfaces of photosensitive material 33. Hence, the chemical reaction between photosensitive material 33 and the fresh processing solution reaching the surface of photosensitive material 33 may be controlled.

Additional slot nozzles may be utilized to control the amount of chemical reaction between the fresh processing solution and photosensitive material 33. Thus, the volume of tank 12 containing processing solution i.e. space 10, was substantially reduced, while providing increased solution agitation and increased photographic processing solution activity.

Figure 7:
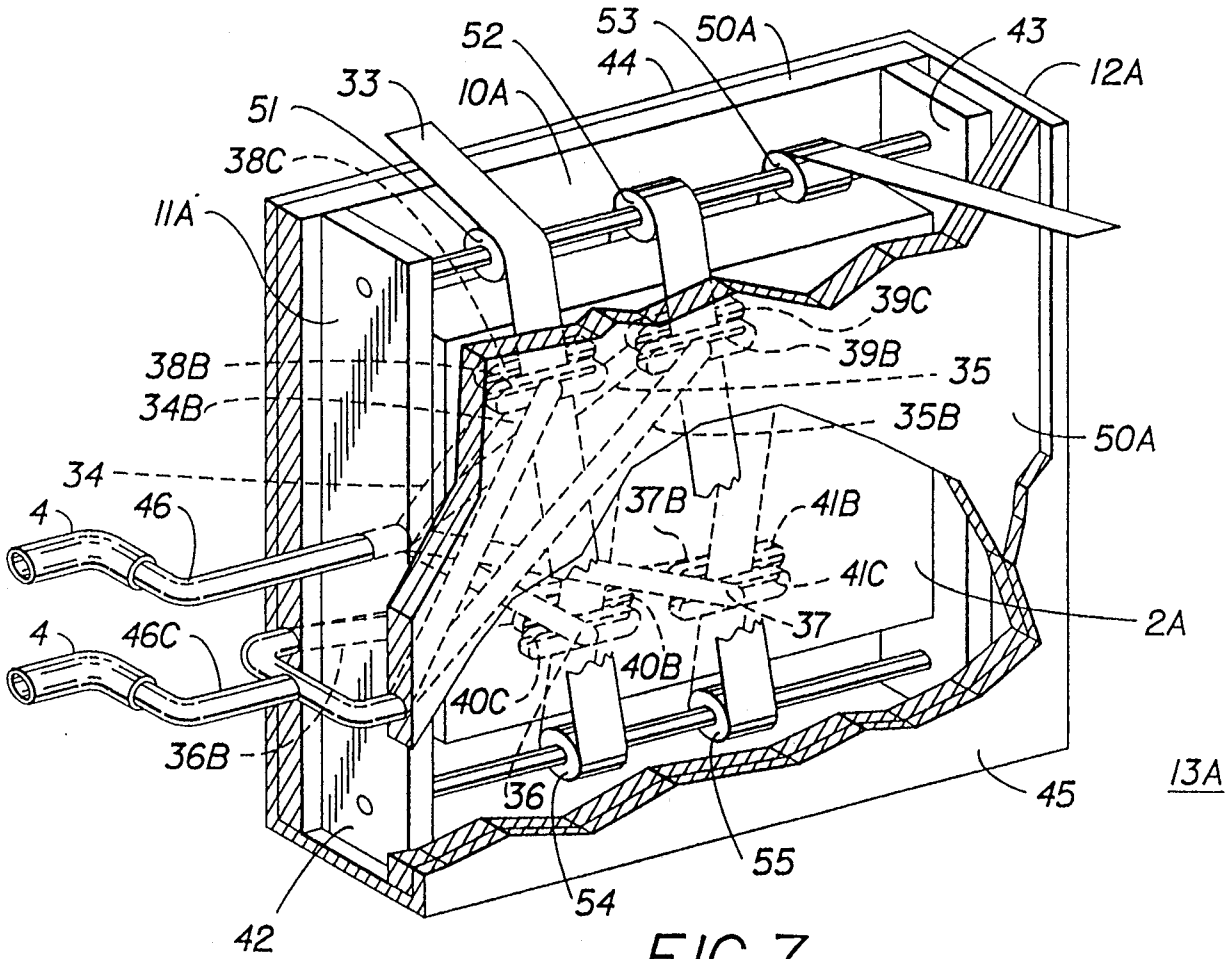
FIG. 7 is a perspective drawing showing rack 11A, tank 12A and insert 2 being used to convert a existing larger volume processing vessel 13 into a lower volume tank.

FIG. 7 is a perspective drawing showing rack 11A, tank 12A and insert 2 being used to convert a existing larger volume processing vessel 13A into a lower volume tank. In this embodiment nozzles 38C–41C are located in insert 2 and nozzles 38C–41C are located in insert 50A. Rack 11A comprises rollers 51, 52, 53, 54 and 55 and side supports 42 and 43. Rollers 51, 52, 53, 54 and 55 are used to transport photosensitive material 33 through space 10. Rack 11A and tank 12A are examples of a typical rack and a typical tank that are currently being used in large photographic processing apparatus. Rack 11A and tank 12A may be respectively substituted for rack 11 and tank 12 of FIG. 1.

When inserts 2 and 50A are placed in rack 11A and tank 12A, a low volume space 10 is formed. Insert 2 is attached to rack 11A side supports 42 and 43 by any known means, i.e., screws, rivets, etc., and insert 50A is attached to walls 44 and 45 of tank 12A, by any known means i.e. screws, rivets, etc.

Photographic processing solution will pass through insert 2 and insert 50A via inlet 4 and then the solution will proceed through connector 46C, conduits 34, 35, 36, 37, 34B, 35B, 36B and 37B to nozzles 38, 39, 40, 41, 38C, 39C, 40C and 41C. At this point the processing solution will exit slot nozzles 38, 39, 40, 41, 38C, 39C, 40C and 41C and enter space 10 of vessel 13 impinging on photosensitive material 33.

Slot nozzles 38, 39, 40, 41, 38C, 39C, 40C and 41C fluid distribution pattern meets or exceeds the width of photosensitive material 33. The amount of fresh processing solution exiting slot nozzles 38C, 39C, 40C and 41C is at a sufficient velocity to disrupt the boundary layer of exhausted processing solution allowing fresh processing solution to reach the surfaces of photosensitive material 33. Slot nozzles 38–41 and slot nozzles 38C–41C permit the velocity of the exiting processing solution to be varied by changing the pressure of the solution. Thus, controlling the amount of fresh processing solution reaching the surfaces of photosensitive material 33. Hence, the chemical reaction between photosensitive material 33 and the fresh processing solution reaching the surface of photosensitive material 33 may be controlled.

Additional slot nozzles may be utilized to control the amount of chemical reaction between the fresh processing solution and photosensitive material 33. Thus, the processing solution volume of tank 12A in space 10 was substantially reduced while providing increased solution agitation and increased solution activity.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

What is claimed is:

1. A kit for retrofitting a tank for containing a processing solution in an apparatus for processing photosensitive material, the kit comprising a pair of inserts for placement adjacent opposite side walls of the tank and a rack for placement between the inserts, said inserts, rack, and tank being dimensioned so that a low volume thin processing chamber is provided between said inserts and rack.

2. A kit for retrofitting a tank for containing processing solution in an apparatus for processing photosensitive material, the kit comprising a pair of inserts for placement adjacent opposite side walls of the tank and a rack for placement between the inserts, said inserts, rack, and tank being dimensioned so that a low volume thin processing chamber is provided between said inserts and rack, said rack containing first fluid displacing means to displace sufficient processing solution so that a small low volume for holding moving processing solution and photosensitive material is formed between the rack and said inserts; and at least one slot nozzle is also provided in said rack for providing impinging processing solution against the photosensitive material so as to disrupt the exhaustive processing solution on the surface of the photosensitive material.

* * * * *